United States Patent [19]

Anastasio et al.

[11] Patent Number: 4,499,831

[45] Date of Patent: Feb. 19, 1985

[54] FLEXIBLE COUPLING FOR A GRAVURE CYLINDER

[75] Inventors: Frank J. Anastasio, Paramus; Thomas Byro, Ringwood, both of N.J.

[73] Assignee: Bobst SA, Lausanne, Switzerland

[21] Appl. No.: 428,240

[22] Filed: Sep. 29, 1982

[51] Int. Cl.[3] ..... B41F 9/02; B41F 13/14

[52] U.S. Cl. ..... 101/152; 101/248

[58] Field of Search ..... 101/152, 153, 248, 181; 464/98, 99, 97

[56] References Cited

U.S. PATENT DOCUMENTS 2,129,699 9/1938 Luehrs ..... 101/152 X
2,188,510 1/1940 Lapsley ..... 464/98 X
2,630,065 3/1953 Caulfield .
3,625,145 12/1971 Heatley, Jr. et al. .
4,265,099 5/1981 Johnson et al. ..... 464/99

*Primary Examiner*—J. Reed Fisher
*Attorney, Agent, or Firm*—Hill, Van Santen, Steadman & Simpson

[57] ABSTRACT

A coupling for use in transmitting both rotational movement and axial forces from a drive shaft to a driven shaft such as a shaft of a gravure cylinder characterized by a pin member being secured on the axis of both hubs to maintain the spacing between the hubs as a flexible plate arrangement secured to the hubs allows annular misalignment between the axes of the two hubs. The coupling allows side register of the gravure cylinder to be adjusted by shifting the drive shaft in the gear box of the printing press.

6 Claims, 5 Drawing Figures

FIG. 1
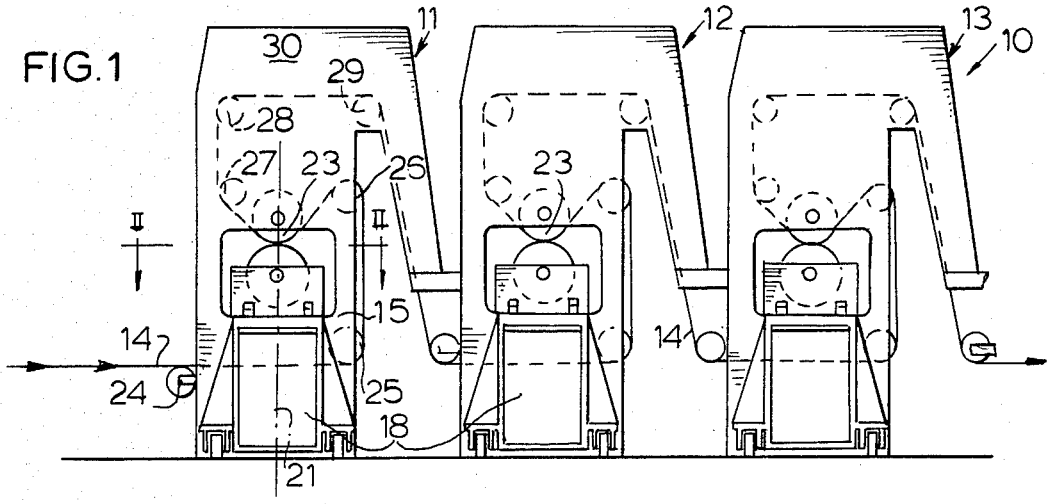
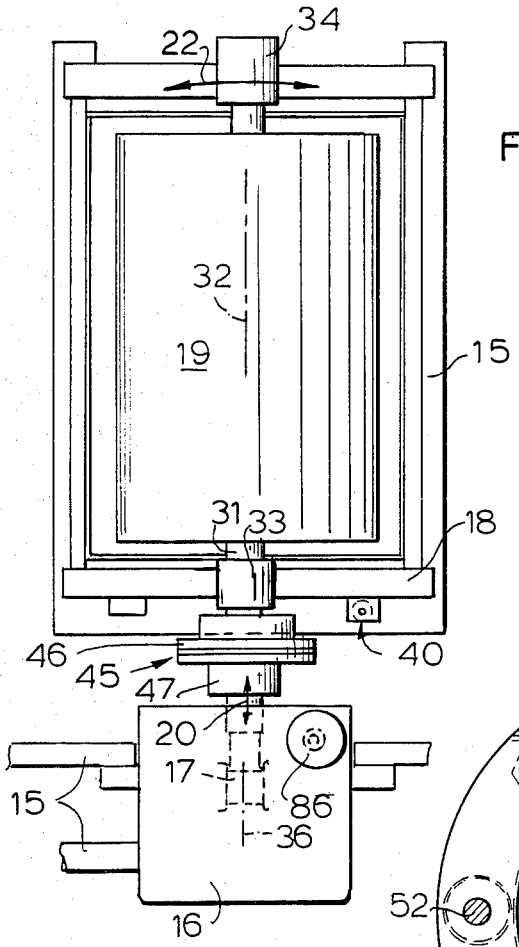
FIG. 2
FIG. 4
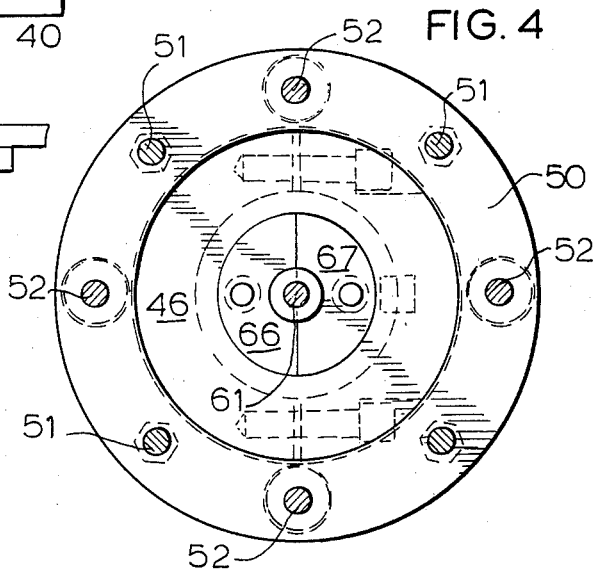

FLEXIBLE COUPLING FOR A GRAVURE CYLINDER

BACKGROUND OF THE INVENTION

The present invention is directed to a flexible coupling which has zero backlash in torsion or rotation and also has zero axial backlash. The coupling is particularly useful for connecting a gravure printing cylinder to the main drive box of the printing unit and enables controlling side register of the cylinder by axially shifting the drive shaft.

In a rotogravure press, an engraved cylinder, which has tiny cells for receiving and holding ink, transfers the ink to a sheet or web of material which is pressed onto the engraved cylinder by an impression roller. To provide different colors the press has a series of printing units each containing a cylinder and impression roller and associated parts such as an ink applicator and a doctor blade for removing excess ink. An example of such a gravure press is disclosed in U.S. Pat. No. 2,630,065.

Very often the engraved copy is not always perfectly aligned to the axis of the printing cylinder. Thus, under normal conditions this misalignment of the engraved copy would cause the printed copy for the color of that cylinder to be out of square with the other colors making good register impossible. To compensate for this, the gravure printing cylinder, the ink applicator, and the doctor blades are all mounted in a carriage, which is movable in the frame of the device, and the carriage can be tilted or pivoted around a point which is on the centerline or axis of the drive shaft for the cylinder. The pivoting is accomplished by use of a cam arrangement. By adjusting the cam arrangement, the axis of the gravure printing cylinder can be pivoted relative to the drive shaft axis. With such a pivoting, a coupling, which allows angular misalignment between the axis of the drive shaft of the gear box and the axis of the printing cylinder, is necessary. One type of coupling is known as a Thomas coupling and comprises a pair of hubs with a pack of flexible metal plates positioned between the faces of the hubs and attached to both hubs by spaced bolts so that an angular misalignment between a drive shaft and a driven shaft can be compensated for with a zero backlash in torsion or rotation. However, the coupling does have considerable axial backlash.

In addition to obtaining register due to changing the axis of the printing cylinder relative to the drive shaft, it is also necessary to obtain side printing register which is along the direction of the axis of the cylinder. At present, this is obtained manually by an arrangement or means which shifts the carriage of the printing cylinder relative to the frame of the printing unit to obtain the desired position of the printing cylinder in the frame.

SUMMARY OF THE INVENTION

The present invention is directed to providing a coupling, which compensates for angular misalignment between the axis of a driven shaft and a drive shaft and which coupling has zero torsional or rotational backlash and also zero axial backlash. The coupling is particularly useful in transmitting an axial adjustment force between the drive shaft and the driven shaft and thus enables side register of a printing cylinder by applying an axial force through the gear box of the printing unit and the drive shaft which is coupled to the printing cylinder.

To accomplish these goals, the present invention is directed to an improvement in a coupling for transmitting rotational motion between two shafts, said coupling having a pair of hubs for securing to the respective shafts and means for transmitting rotation between the two hubs allowing angular misalignment of the axis of one hub relative to the axis of the other hub, said means including at least one plate member disposed between the hubs and means for securing the plate member to each hub. The improvement comprises means for preventing axial backlash between the hubs and for transmitting an axial force from one hub to the other hub while maintaining the interval between said hubs at the axes thereof.

The improved coupling is also useful in an improvement in a printing press having a plurality of printing units, each printing unit including a unit frame having a housing supporting a drive shaft connected to a source of rotational motion, a printing cylinder mounted for rotation in a printing carriage having means for applying ink to the cylinder, said printing carriage being mounted in the unit frame for movement along the axis of the cylinder and for pivoting in the frame on a point on the axis of the drive shaft for changing the angle of the axis of the cylinder relative to the axis of the drive shaft, coupling means for connecting the drive shaft to the cylinder, means for shifting the cylinder axially in the frame of the unit and means for pivoting the carriage on said pivot point in the frame of the unit. The improvement comprises that the means for shifting the cylinder along the axis of the cylinder includes means shifting the drive shaft along its axis in the housing and the coupling means including a pair of hubs with one hub secured to the shaft of the cylinder and the second hub secured to the drive shaft, at least one flexible plate member disposed between said hubs, means securing said plate member to each of the hubs to transfer rotation therebetween and means for preventing axial backlash between the hubs and for transmitting an axial force from the second hub secured to the drive shaft to the one hub secured to the printing cylinder so that the axial interval between the hubs at the axes of the hubs remains constant even during shifting of the drive shaft and cylinder.

Preferably, the means for preventing axial backlash and for transmitting an axial force comprises a member secured to each of the hubs at the axis of each hub. The member is preferably made of material, which is resistant to repeated bending stresses and strong enough to transmit the axial forces between the hubs. Preferably, the member is a cylindrical pin member having means for securing the ends of the pin member on the axis of each hub. The means for securing comprises an axial recess in each hub and the pin member having mounting means disposed at each end received and secured in the axial recess of the hubs.

The pin member maintains the axes of each of the hubs at the same distance from each other regardless of any axial force applied on either of the hubs. The pin member also will enable a small amount of angular misalignment or pivoting between the axes of the two hubs while preventing any axial backlash.

BRIEF DESCRIPTION OF THE DRAWINGS

FIG. 1 is a schematic side view of several printing units of a printing press incorporating the present invention;

FIG. 2 is a plan view taken along lines II—II of FIG. 1;

FIG. 4 is a cross-sectional view taken along the lines IV—IV of FIG. 3; and

DESCRIPTION OF THE PREFERRED EMBODIMENTS

Figure 3:
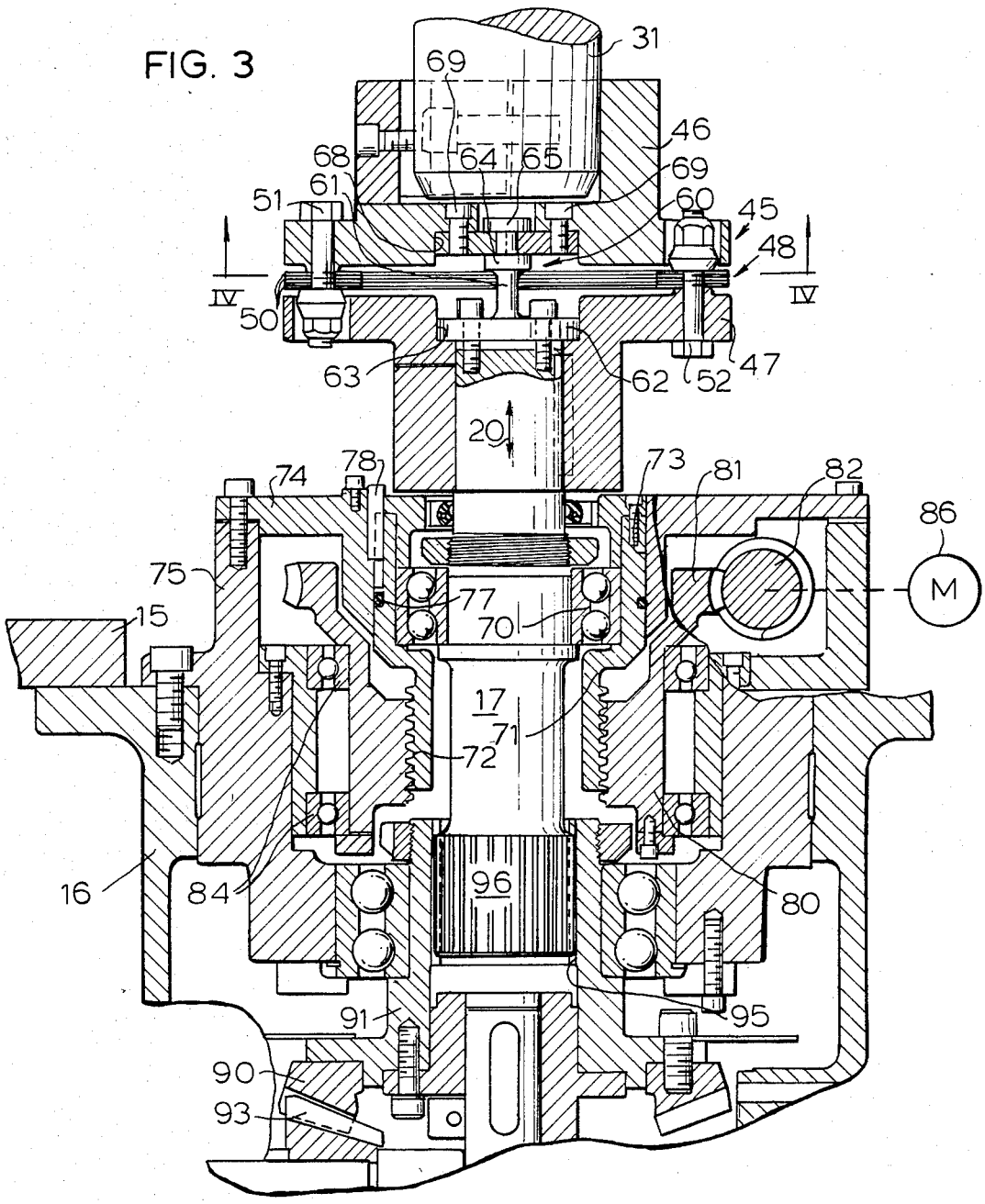
FIG. 3 is a partial longitudinal cross-sectional view of the coupling and drive shaft of the present invention.

The principles of the present invention are particularly useful in a coupling for transmitting rotary motion between two shafts, which coupling is particularly useful in a rotogravure printing press generally indicated at 10 in FIG. 1. The press 10 has a plurality of printing stations or units generally indicated at 11, 12 and 13. Each of the printing stations enables printing different information such as different colors on a web 14 which passes in succession through the various printing stations or units.

Each of the printing stations or units has a unit frame 15 which supports a housing 16 containing a drive shaft 17 and receives a carriage 18 for a gravure printing cylinder 19. The carriage 18 will also include applicators for applying ink to the surface of the cylinder 19 and doctor blades for removing excess ink which elements are not illustrated in the drawings such as FIG. 2 but examples are disclosed in the above mentioned U.S. Pat. No. 2,630,065 which is incorporated by reference thereto. Each of the cylinders 19 are movable in the frame 15 of the printing unit in both an axial direction as indicated by an arrow 20 in FIG. 2 and also around a pivot point which lies on the axis of the drive shaft 1 as indicated by a line 21 in FIG. 1 as indicated by arrow 22 in FIG. 2.

Each of the units 11, 12 and 13 include a pressure roll 23. The units also include a plurality of rolls such as 24, 25, 26, 27, 28 and 29 which guide the web 14 between the pressure roll 23 and the cylinder 19 and also through a drying chamber 30 in the upper part of the unit prior to passing into the next unit such as 12.

As best illustrated in FIG. 2, the gravure cylinder 19 has a shaft 31 and is mounted in the carriage 18 for rotation on its axis 32 by bearing assemblies 33 and 34. By moving the carriage 18 relative to the frame 15, the axis 32 can be angularly misaligned with an axis 36 of the drive shaft 17 which is best illustrated in FIG. 3. To accomplish this misalignment, a conventional cam arrangement generally indicated at 40 can be utilized. Such a cam arrangement is disclosed in greater detail in FIG. 10 of U.S. Pat. No. 3,625,145 whose disclosure is incorporated by reference thereto. Basically, the cam has an eccentric surface so that by rotating the cam about its axis a slight pivoting of the carriage 18 in the frame 15 will occur.

To connect the cylinder 19 to the drive shaft 17 a coupling generally indicated at 45 in FIG. 2 and illustrated in greater detail in FIG. 3 is utilized. Basically, the coupling 45 has a pair of hubs 46 and 47 with the one hub 46 being connected to the shaft 31 of the cylinder 19 and a second hub 47 being connected to the drive shaft 17. The coupling 45 includes means 48 for transmitting rotational movement between the two hubs without any rotational backlash. This means 48, as illustrated in FIG. 3, comprises a pack of a plurality of annular metal plates 50, which are alternatively connected to hub 46 by bolts 51 and to hub 47 by bolts 52. As illustrated in FIG. 4, there are four bolts 51 that are alternately arranged with four bolts 52. Briefly, an arrangement of the hubs 45 and 46 with the pack of annular metal plates 50 which are secured by bolts 51 and 52 to the two hubs forms what is known in the art as a Thomas coupling.

Figure 5:
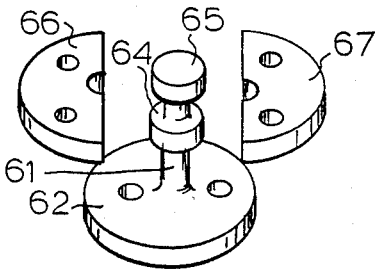
FIG. 5 is an exploded view of the pin arrangement of the present invention.

The improvement of the present invention is that the coupling 45 also includes a means generally indicated at 60 (FIG. 3) for preventing axial backlash between the two hubs and for transferring an axial force applied in the direction of the arrow 20. As illustrated, the means 60 include a metal pin member 61 which is secured to each hub on the axis of the two hubs 46 and 47. The pin member 61 has an integral flange 62 (FIG. 5) which is received in a recess 63 and is secured by bolts either to the hub 47 or to the shaft 17 as illustrated in FIG. 3. The opposite end of the pin 61 is provided with two spaced small flanges 64 and 65 which form a neck portion that receives semi-circular members 66 and 67, which are best illustrated in FIG. 5. The hub 46 has a recess 68 that receives members 66 and 67 which are secured in the recess 68 by threaded fasteners 69.

The shaft 17 is mounted for rotation by a thrust bearing arrangement 70 in a sleeve member 71 which has external threads 72 and is slidably received in a cylindrical bearing 73 of member 74 which is secured to a housing member 75 of housing 16. To prevent loss of oil, seals such as 77 are provided and to prevent rotation between the sleeve 71 and the housing 16, a keyway or spline arrangement 78 is utilized. Surrounding the member 71 is a concentrically arranged member 80 which is threadably engaged on the external threads 72 and is provided with a worm gear 81 driven by a gear 82. The member 80 is mounted by bearings 84 for rotation in housing 16. Thus, rotation of the gear 82, which is connected to motor 86, in one direction will rotate the member 80 to cause the member 71 to be threaded in or out along the axis of the shaft 17. The drive shaft 17 will be shifted in direction 20.

The housing or gear box 16 containing a bevel gear 90 is mounted on a member 91 which member is mounted for rotation by bearings in the member 75. A pinion such as 93 is in driving engagement with the gear 90 to transfer rotational movement to the member 91 which has a spline arrangement 95 that engages a splined end 96 of shaft 17 and allows axial movement of the shaft 17 relative to the member 91. While the gears 93 may be attached directly to a single source of rotational movement, it can also be attached to a common shaft which drives the adjacent printing cylinder in a conventional manner and the drive shafts can be provided with means to maintain longitudinal register between the various printing units or stations.

As mentioned hereinabove, rotation of the worm gear 82 causes an axial shifting of the annular member 71 to shift the drive shaft 17 in the direction of the arrow 20. The input to the gear shaft 82 may be a manual input instead of an input from a motor 86 which is either manually controlled or controlled through a side register system.

In the means 60 for preventing axial backlash and for transmitting axial forces, the pin member 61 is selected from a material and is provided with a dimension so that it can be subjected to repeated bending stresses during rotation of the printing cylinder even though the axis 32 of the cylinder 19 and the axis of the drive shaft 17 are angularly misaligned. While it is believed that various dimensions and materials can be used for the pin 61, high strength steels have proven satisfactory. For example, applicants have found the use of a steel manufactured by La Salle Steel Company and sold under the trademark "Fatigue-Proof" as being satisfactory when the diameter of the pin 61 between the flanges 62 and 64 approximately $\frac{3}{8}$". The fatigue-proof steel is understood to be an AISI 1144 steel which has been either cold-drawn and stress-relieved or drawn at an elevated temperature. This particular steel has a minimum yield strength of 120,000 psi and a minimum tensile strength of 140,000 psi.

Due to the rigid coupling formed by the member 61 between the two hubs 46 and 47 and due to the fact that the fit between the semi-circular pieces 66 and 67 and the pin member 61 is a tight fit, the axial tolerance in the hub is 0.001" or less whereas without the use of the pin member 61, the previously known Thomas coupler had a tolerance of 0.03". Thus, attempting to utilize an axial shift of the drive shaft 17 to cause side register would not work with the prior known Thomas coupling due to the high backlash caused by the tolerance.

Although various minor modifications may be suggested by those versed in the art, it should be understood that we wish to embody within the scope of the patent granted hereon, all such modifications as reasonably and properly come within the scope of our contribution to the art.

We claim:

1. In a printing press having a plurality of printing units, each printing unit including a unit frame having a housing supporting a drive shaft connected to a source of rotational motion, a printing cylinder mounted for rotation in a printing carriage having means for applying ink to the cylinder, said printing carriage being mounted in the unit frame for pivoting on a point on the axis of the drive shaft for changing the angle of the axis of the cylinder relative to the axis of the drive shaft, coupling means for connecting the drive shaft to the cylinder, means for shifting the cylinder axially in the frame of the unit and means for pivoting the carriage on said pivot point, the improvements comprising said means for shifting the cylinder along the axis of the cylinder including means for shifting the drive shaft along its axis in the housing and said coupling means including a pair of hubs with one hub secured to a shaft of the cylinder and the second hub secured to the drive shaft, at least one flexible plate member disposed between said hubs, means securing said plate members to each of the hubs to transfer rotation therebetween and means for preventing axial backlash between the hubs and for transmitting an axial force from the second hub secured to the drive shaft to the one hub secured to the printing cylinder so that the axial interval between the hubs at the axes of the hubs remains constant even during shifting of the drive shaft and cylinder, said means for preventing axial backlash and for transmitting an axial force comprising a cylindrical member extending between the hubs, and each hub and cylindrical member having means for securing each end of the cylindrical member to the respective hub on the axis thereof for rotation therewith.

2. In a printing press according to claim 1, wherein said means for shifting the drive shaft includes a first sleeve member supporting the drive shaft for rotation and having external threads, a second sleeve member having internal threads engaging the external thread and being mounted for rotation in the housing, and means for rotation of said second member to cause the first member to be moved along the axis of the drive shaft to axial shift the drive shaft.

3. In a printing press according to claim 2, wherein said means for rotation include a gear connected to said second member and engaged by a gear on an input shaft.

4. In a printing press according to claim 1, wherein said means for securing include each hub having an axial recess, and said cylindrical member having means for forming a flange at each end for securing in the recesses.

5. In a printing press according to claim 4, wherein the means for forming a flange at each end include an integral flange at one end and a pair of pieces received in a neck portion of the cylindrical member at the other end.

6. In a printing press according to claim 5, wherein the neck portion is formed by a pair of spaced small diameter flanges.

* * * * *